US011162718B2

(12) United States Patent
Draenkow et al.

(10) Patent No.: US 11,162,718 B2
(45) Date of Patent: Nov. 2, 2021

(54) STACKED PLATE HEAT EXCHANGER

(71) Applicant: Mahle International GmbH, Stuttgart (DE)

(72) Inventors: Andreas Draenkow, Heimsheim (DE); Timo Feldkeller, Asperg (DE); Thomas Merten, Knittlingen (DE)

(73) Assignee: Mahle International GmbH

( * ) Notice: Subject to any disclaimer, the term of this patent is extended or adjusted under 35 U.S.C. 154(b) by 167 days.

(21) Appl. No.: 16/251,038

(22) Filed: Jan. 17, 2019

(65) Prior Publication Data

US 2019/0219313 A1 Jul. 18, 2019

(30) Foreign Application Priority Data

Jan. 18, 2018 (DE) ..... 102018200809.4

(51) Int. Cl.

| | |
|---|---|
| ***F25B 39/02*** | (2006.01) |
| ***F28D 9/00*** | (2006.01) |
| ***F28F 3/04*** | (2006.01) |
| ***F28F 3/06*** | (2006.01) |
| ***F28F 3/02*** | (2006.01) |
| ***F28D 1/03*** | (2006.01) |

(Continued)

(52) U.S. Cl.

CPC ..... *F25B 39/022* (2013.01); *F28D 1/0333* (2013.01); *F28D 9/005* (2013.01); *F28D 9/0056* (2013.01); *F28F 3/027* (2013.01); *F28F 3/04* (2013.01); *F28F 3/044* (2013.01); *F28F 3/046* (2013.01); *F28F 3/06* (2013.01); *F25B 39/04* (2013.01); *F25B 2339/043* (2013.01); *F28D 2021/0085* (2013.01)

(58) Field of Classification Search

CPC ..... F25B 39/022; F28D 1/0333; F28D 9/005; F28D 9/0056; F28F 3/04; F28F 3/044; F28F 3/046

See application file for complete search history.

(56) References Cited

U.S. PATENT DOCUMENTS

| | | | | |
|---|---|---|---|---|
| 5,172,759 | A * | 12/1992 | Shimoya | F25B 39/022 165/110 |
| 5,735,343 | A | 4/1998 | Kajikawa et al. | |
| 2015/0233650 | A1 * | 8/2015 | Blomgren | F28D 9/00 165/166 |

FOREIGN PATENT DOCUMENTS

DE 10 2012 107 381 A1 5/2014

OTHER PUBLICATIONS

English abstract for DE-10 2012 107 381.

* cited by examiner

*Primary Examiner* — Jon T. Schermerhorn, Jr.

(74) *Attorney, Agent, or Firm* — Fishman Stewart PLLC

(57) ABSTRACT

A stacked plate heat exchanger for a motor vehicle may include a plurality of elongated plates stacked on one another between which a plurality of cavities are disposed alternately for two media. The plurality of cavities may be respectively delimited by a respective plate of the plurality of plates zonally by a plate surface and a surrounding wall. The respective plate may include two flow openings, two passage openings, and two domes respectively arranged around one of the two passage openings. At least of one of the plurality of plates may further include an elongated separation shaping arranged on the plate surface, projecting into the respective cavity, and extending from the first short side between the two flow openings in a direction of the second short side. The separation shaping may adjoin the first short side at an angle α of 45° to 90°.

18 Claims, 4 Drawing Sheets

(51) Int. Cl.
*F25B 39/04* (2006.01)
*F28D 21/00* (2006.01)

STACKED PLATE HEAT EXCHANGER

CROSS-REFERENCE TO RELATED APPLICATION

This application claims priority to German Application No. DE 10 2018 200 809.4, filed on Jan. 18, 2018, the contents of which are hereby incorporated by reference in its entirety.

TECHNICAL FIELD

The invention relates to a stacked plate heat exchanger, in particular an oil cooler, a chiller or a condenser for a motor vehicle.

BACKGROUND

Stacked plate heat exchangers are already known from the prior art and are used for example as oil coolers, chillers or condensers in a motor vehicle. A stacked plate heat exchanger has here several elongate plates stacked on one another, between which cavities are formed. In the cavities, arranged on one another, two media flow—a cooling medium and a medium which is to be cooled, —so that a heat exchange can take place between the two media. The cavities are delimited here by a surface and a surface edge of the respective plate and by the adjacent resting plate. In each of the plates, four openings are formed which correspond with one another in the plates lying on one another and form a total of four channels perpendicular to the plates. Two of these channels are provided for the feeding and discharging of the one medium, and two of these channels are provided for the feeding and discharging of the other medium into the respective cavities. The cavities for the two media alternate here in the stacked plate heat exchanger, and the channels are fluidically connected exclusively with the corresponding cavities.

The respective medium flows from one opening to the other opening over the surface of the respective plate. The flow can be u-shaped, for example, as is described in DE 10 2012 107 381 A1. In order to enlarge the surface of the plate taking part in the heat exchange, an elongate shaping—a so-called bead—is formed on the plate. The shaping extends here parallel to the longitudinal centre axis of the respective plate and separates the two openings from one another.

The respective medium can thereby not flow directly from the one opening to the other opening, and the heat exchange is intensified. Alternatively to a u-shaped flow, other flows can also be provided, such as is described for example in U.S. Pat. No. 5,735,343 A. Here, the bead separates the surface of the plate into two parts, so that each of the parts is flowed through separately by the respective medium.

In the stacked plate heat exchanger, at least one of the media changes its aggregate state from gaseous to liquid or respectively from liquid to gaseous, and the volume flow changes accordingly. Here, the volume of the medium available for heat exchange is not utilized optimally, and the output- and pressure ratio in the stacked plate heat exchanger is thereby not optimum.

SUMMARY

It is therefore the object of the invention to indicate for a stacked plate heat exchanger of the generic type an improved or at least alternative embodiment, in which the described disadvantages are overcome.

This problem is solved according to the invention by the subject of the independent claim(s). Advantageous embodiments are the subject of the dependent claim(s).

The present invention is based on the general idea of adapting a flow cross-section in a stacked plate heat exchanger to an aggregate state of a medium which is flowing through. The stacked plate heat exchanger here can be, in particular, an oil cooler, a chiller or a condenser for a motor vehicle. The stacked plate heat exchanger has several elongate plates stacked on one another, between which cavities are formed in an alternating manner for two media—a cooling medium and a medium which is to be cooled. The cavities are delimited at the respective plates zonally by respectively a plate surface and a surrounding wall projecting from the plate surface and running around the latter. In the respective plate, in addition, two flow openings are formed in an adjacent manner on a first short side and two passage openings on a second short side lying opposite the first short side, wherein in the respective plate around the two passage openings respectively a dome is formed projecting from the plate surface into the cavity. On the plate surface at least of one of the plates, an elongate separation shaping is formed, projecting into the cavity, which separation shaping extends from the first short side between the two flow openings in the direction of the second short side. According to the invention, the separation shaping adjoins the first short side at an angle $\alpha$ between 45° and 90°.

The two short sides are connected with one another by long sides, which are longer than the two short sides. The plate surface is substantially rectangular, and the two short sides and the two long sides are respectively equal in length. The separation shaping divides the plate surface into two flow regions. Here, the first flow region surrounds the first flow opening for the inflow of the respective medium, and extends between the separation shaping and the one long side from the first short side to the second short side. The second flow region surrounds the second flow opening for the outflow of the respective medium, and extends between the separation shaping and the other long side from the first short side to the second short side. The two flow regions are separated fluidically from one another along the separation shaping, and are only connected fluidically with one another at the second short side. The separation shaping adjoins the first short side here, so that no flow can take place along the first short side, and the respective medium is forced to a u-shaped flow in the respective plate. Through the fact that the separation shaping adjoins the first short side at an angle, the flow cross-section changes in the flow direction of the respective medium. In particular, the flow cross-section is adaptable to the aggregate state of the respective medium, so that the output- and pressure ratio in the stacked plate heat exchanger can be optimized, and the volume available for the heat exchange can be utilized optimally. The several plates, stacked on one another, can be configured so as to be identical here, or can differ from plate to plate.

Advantageously, provision can be made that the separation shaping is rectilinear or is curved towards a long side connecting the two short sides. The separation shaping can also have at least two rectilinear separation regions, which adjoin one another at a bend angle. A ratio of a length of one of the separation regions to a total length of the separation shaping then lies between 0 and 1. With the ratio equal to 0 or 1, the one separation region continues into the other separation region, so that the separation shaping in the two separation regions corresponds to the rectilinear separation shaping. By an adaptation of the bend angle, the flow at the respective plate and thereby also the heat exchange between the two media can be optimized. The bend angle β can vary here between 90° and 180°.

Advantageously, the separation shaping divides the first short side in a ratio between 0.3 and 0.5 to a total length of the short side. With a ratio equal to 0.5, the separation shaping adjoins the short side centrally, so that the two regions formed by the separation shaping have an identical flow cross-section at least at the first short side. With a smaller ratio, the separation shaping at the first short side is offset to one of the flow openings or respectively to one of the long sides, so that the flow cross-sections differ at least at the first short side. The separation shaping can extend, in addition, up to 0.2 times to 0.8 times the length of the long side from the first short side in the direction of the second short side. The remaining 0.8 times to 0.2 times length of the long side from the second short side in the direction of the first short side then corresponds to the length of a connection region, in which the two flow regions overlap and are fluidically connected with one another.

In order to optimize the flow of the respective medium in the respective flow regions, and the heat exchange in the stacked plate heat exchanger, advantageously at least one flow guide structure can be arranged in the cavity of at least one of the plates. The flow guide structure can guide the respective medium through the flow region and mix it. The respective flow guide structure can be, for example, a turbulence insert. Alternatively, the respective flow guide structure can be formed—stamped, for example—in the plate surface of the respective plate, projecting into the cavity. The flow guide structure can comprise here several nub-like or elongate or undulating shapings. Advantageously, on both sides on the separation shaping of at least one of the plates respectively a flow guide structure can be arranged, and the respective flow guide structures can be configured so as to be identical or different. Thereby, a great variety of possible configurations of the respective plate arise, so that the flow and the heat exchange in the respective plate are able to be adapted to the respective medium and to the changing aggregate state of the respective medium.

In an advantageous further development of the stacked plate heat exchanger according to the invention, provision can be made that the flow openings and/or the passage openings at least of one of the plates have a flow cross-section differing from one another. In addition, the flow openings and the passage openings of the plates which are stacked on one another can correspond with one another fluidically, and flow cross-sections of the flow- and passage openings of the plates which are stacked on one another in the stacked plate heat exchanger can continuously increase or decrease from plate to plate. In this advantageous manner, a flow cross-section of a channel formed by the flow- and passage openings can continuously increase or decrease. The ratio of the minimum flow cross-section to the maximum flow cross-section of the respective channel can lie here between 0.25 and 1. In this advantageous manner, the flow cross-section of the respective channel can also be adapted to the aggregate state of the through-flowing medium.

In summary, in the stacked plate heat exchanger according to the invention, the flow cross-section in the respective plate can be adapted to the aggregate state of the respective through-flowing medium. Thereby, the output- and pressure ratio in the stacked plate heat exchanger can be optimized, and the volume available for heat exchange can be utilized optimally. Advantageously, the stacked plate heat exchanger can then have fewer or respectively smaller plates, without the output of the stacked plate heat exchanger being reduced. Cost advantages result considerably thereby.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown, respectively diagrammatically

DETAILED DESCRIPTION

Figure 1:
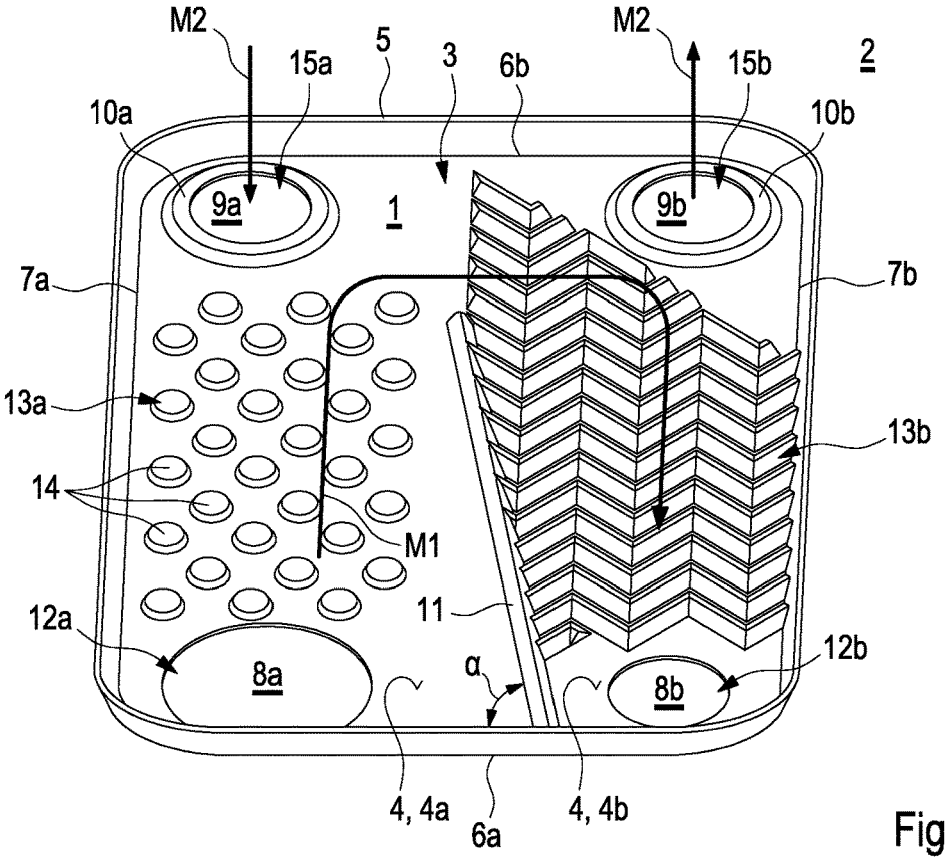
FIG. 1 shows a view of a plate in a stacked plate heat exchanger according to the invention, which has a rectilinear separation shaping.

FIG. 1 shows a view of a plate 1 in a stacked plate heat exchanger 2 according to the invention. On the respective plate 1, a cavity 3 is delimited zonally by a plate surface 4 and a surrounding wall 5, which projects from the plate surface 4 and runs around the latter. The stacked plate heat exchanger 2 has several such plates 1 stacked on one another, between which the cavities 3 are formed. In particular, the stacked plate heat exchanger 2 can be an oil cooler, a chiller or a condenser for a motor vehicle.

The respective plate 1 is shaped so as to be elongate and has a first short side 6*a* and a second short side 6*b* lying opposite the first short side 6*a*. The two short sides 6*a* and 6*b* are connected with one another by two opposite long sides 7*a* and 7*b*. The short sides 6*a* and 6*b* and the long sides 7*a* and 7*b* delimit the plate surface 4. On the first short side 6*a*, two flow openings 8*a* and 8*b* are formed. A first medium $M_1$ can flow through the flow openings 8*a* and 8*b* into the cavity 3 and can flow out from the cavity 3. On the second short side 6*b*, two passage openings 9*a* and 9*b* are arranged, around which respectively a dome 10*a* and 10*b* is formed, projecting from the plate surface 4 into the cavity 3. The domes 10*a* and 10*b* prevent an inflow of a second medium $M_2$ into the cavity 3 and an outflow of the first medium $M_1$ out from the cavity 3. The flow openings 8*a* and 8*b* and the passage openings 9*a* and 9*b* alternate in the plates 1 of the stacked plate heat exchanger 2 which lie on one another, so that in the stacked cavities 3 respectively the first medium $M_1$ or the second medium $M_2$ flows. As generally shown in FIGS. 6A, 6B, 7A, and 7B, provision can be made that the flow openings 8*a*, 8*b* and/or the passage openings 9*a*, 9*b* at least of one of the plates 1 have a flow cross-section differing from one another. In addition, the flow openings 8*a*, 8*b* and the passage openings 9*a*, 9*b* of the plates 1 which are stacked on one another can correspond with one another fluidically, and flow cross-sections of the flow- and passage openings 8*a*, 8*b*, 9*a*, 9*b* of the plates 1 which are stacked on one another in the stacked plate heat exchanger 2 can continuously increase or decrease from plate 1 to plate 1. In this advantageous manner, a flow cross-section of a channel 12*a*, 12*b*, 15*a*, 15*b* formed by the flow- and passage openings 8*a*, 8*b*, 9*a*, 9*b* can continuously increase or decrease. The ratio of the minimum flow cross-section to the maximum flow cross-section of the respective channel 12*a*, 12*b*, 15*a*, 15*b* can lie here between 0.25 and 1. In this advantageous manner, the flow cross-section of the respective channel 12*a*, 12*b*, 15*a*, 15*b* can also be adapted to the aggregate state of the through-flowing medium.

On the plate surface 4, an elongate separation shaping 11—a so-called bead—is formed projecting into the cavity 3, which bead extends from the first short side 6*a* between the two flow openings 8*a* and 8*b* in the direction of the second short side 6*b*. Here, the separation shaping 11 adjoins the first short side 6*a* at an angle α, which lies preferably between 45° and 90°. In this example embodiment, the separation shaping 11 is rectilinear and adjoins the first short side 6*a* at an angle α equal to 60°. The separation shaping 11 divides the first short side 6*a* in a ratio of 0.3 to the total length of the first short side 6*a* and extends from the first short side 6*a* in the direction of the second short side 6*b* up 0.8 times the length of the long sides 7*a* and 7*b*.

The separation shaping 11 divides the plate surface 4 into two flow regions 4*a* and 4*b*, which have an unequal flow cross-section. From a feed channel 12*a*, the first medium $M_1$ flows through the first flow opening 8*a* into the first flow region 4*a* and further in the direction of the second short side 6*b*. At the second short side 6*b*, the first medium $M_1$ is diverted and flows in the second flow region 4*b* to the flow opening 8*b* and into the discharge channel 12*b*. The first medium $M_1$ flows in the plate 1 in a u-shaped manner, as indicated here and further by arrows, and the flow cross-section decreases in the flow direction from the flow opening 8*a* to the flow opening 8*b*. The flow cross-section is thereby adapted to the aggregate state of the first medium $M_1$, which changes here from gaseous to liquid, as in a condenser. In particular, the output- and pressure ratio can thereby be optimized in the stacked plate heat exchanger 2, and the volume of the first medium $M_1$ available for the heat exchange can be utilized optimally. In addition, the flow openings 8*a* and 8*b* also have flow cross-sections differing from one another and adapted to the aggregate state of the first medium $M_1$. It shall be understood that the flow cross-section in the plate 1 and the flow cross-sections of the flow openings 8*a* and 8*b* can also be adapted to a first medium $M_1$, which changes the aggregate state from liquid to gaseous—such as for example in a chiller or an evaporator.

In addition, in the flow region 4*a* a first flow guide structure 13*a* is arranged, and in the flow region 4*b* a second flow guide structure 13*b* is arranged. In this example embodiment, the first flow guide structure 13*a* comprises several nubs 14, which are formed integrally—stamped, for example—in the plate surface 4 in the flow region 4*a*, and project into the cavity 3. In this example embodiment, the second flow guide structure 13*b* is formed in an undulating manner and integrally—stamped, for example—on the plate surface 4, and expediently projects into the cavity 3. The flow guide structures 13*a* and 13*b* guide and mix the first medium $M_1$ at the plate 1, and the heat exchange can thereby be intensified. In addition, the separation shaping 11 is formed zonally on the second flow structure 13*b*, so that an unimpeded throughflow of the first medium $M_1$ is prevented at the separation shaping 11.

It shall be understood that plates for the second medium $M_2$ can be configured in an identical manner. At the plate 1 shown here, however, the second medium $M_2$ does not flow, and is delivered through a feed channel 15*a* of the first throughflow opening 9*a* and a discharge channel 15*b* of the second throughflow opening 9*b* into a cavity of a next plate, as is indicated here and further by arrows.

Figure 2:
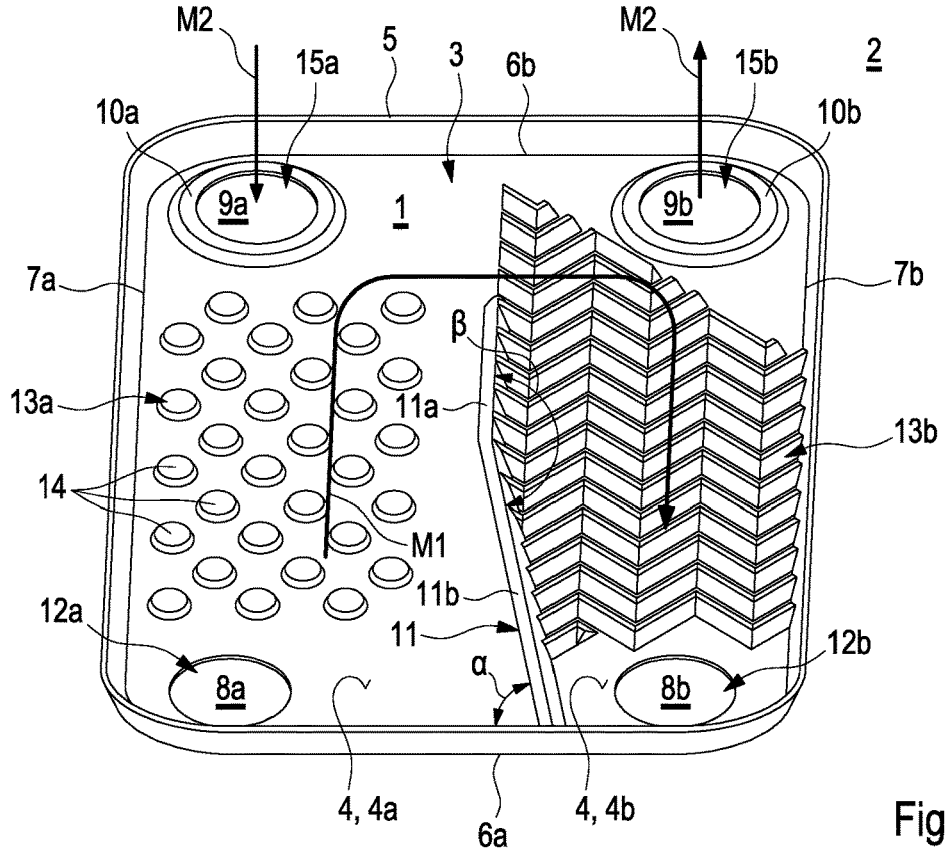
FIG. 2 shows a view of a plate in a stacked plate heat exchanger according to the invention, which has a separation shaping with two separation regions.

FIG. 2 shows a view of the alternatively configured plate 1 in the stacked plate heat exchanger 2 according to the invention. In this example embodiment, the separation shaping 11 has two rectilinear separation regions 11*a* and 11*b*, which adjoin one another at a bend angle β. The bend angle β here is approximately 160°, and a ratio of the length of the shorter separation region 11*a* to the total length of the separation shaping 11 lies at approximately 0.3. Accordingly, a ratio of the length of the longer separation region 11*b* to the total length of the separation shaping 11 is approximately 0.7. In the flow regions 4*a* and 4*b* respectively a flow guide structure 13*a* and 13*b* are arranged. The first flow guide structure 13*a* comprises several nubs 14, and the second flow guide structure 13*b* is shaped in an undulating manner. In this example embodiment, the flow cross-sections of the flow openings 8*a* and 8*b* are identical.

Figure 3:
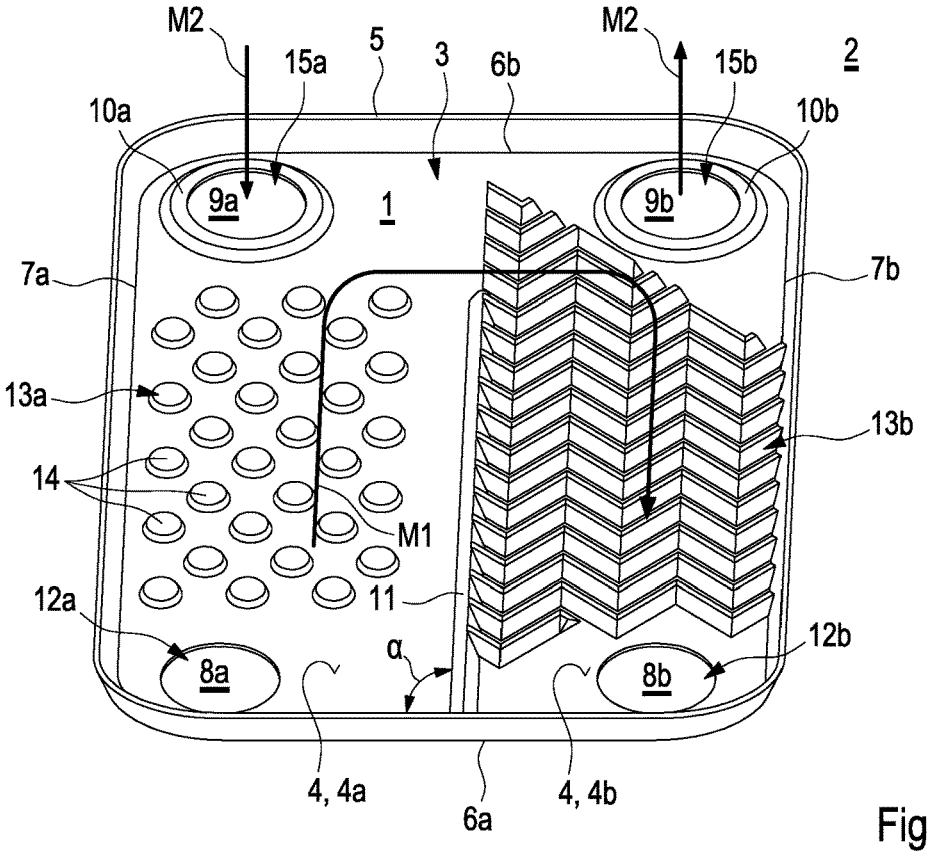
FIG. 3 shows a view of a plate in a stacked plate heat exchanger according to the invention, in which a separation shaping adjoins a short side centrally.

FIG. 3 shows a view of the alternatively configured plate 1 in the stacked plate heat exchanger 2 according to the invention. In this example embodiment, the separation shaping 11 adjoins the first short side 6*a* with the angle α close to 90°. In the flow region 4*a*, the flow guide structure 13*a* is formed with several nubs 14, and in the flow region 4*b* the second undulating flow guide structure 13*b* is formed.

Figure 4:
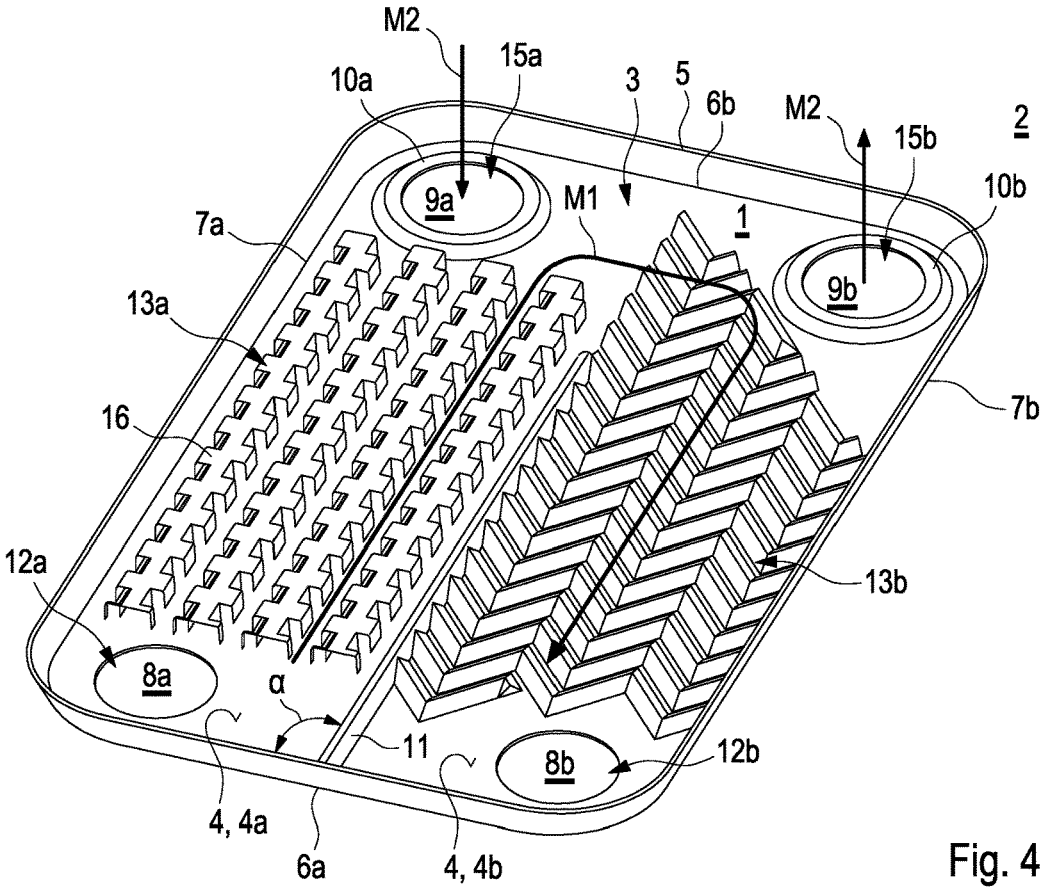
FIG. 4 shows a view of a plate in a stacked plate heat exchanger according to the invention, which has a turbulence insert.

FIG. 4 shows a view of the alternatively configured plate 1 in the stacked plate heat exchanger 2 according to the invention. In the flow region 4*a*, the flow guide structure 13*a* is arranged in the form of a turbulence insert 16, and in the flow region 4*b* the second undulating flow guide structure 13*b* is formed. In this example embodiment, the separation shaping 11 adjoins the first short side 6*a* with the angle α close to 90°.

Figure 5:
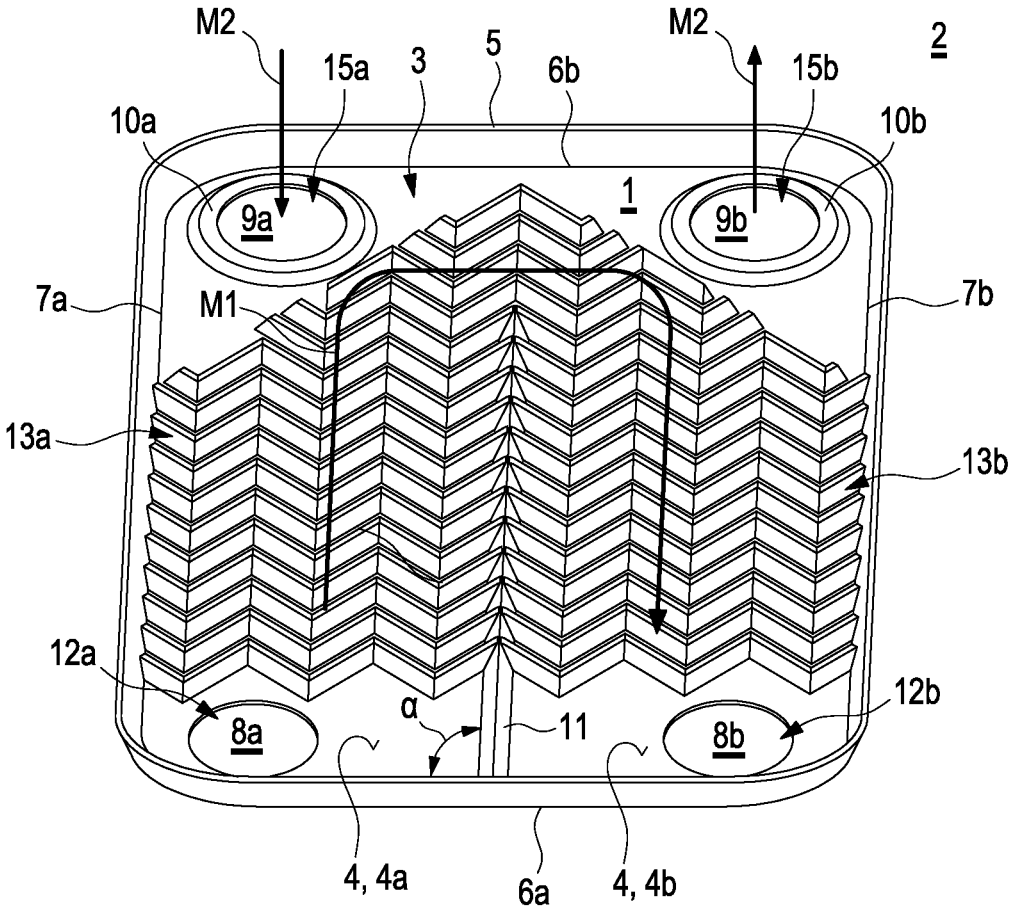
FIG. 5 shows a view of a plate in a stacked plate heat exchanger according to the invention, which has an identical flow guide structure on both sides on a separation shaping.
Figure 6A:
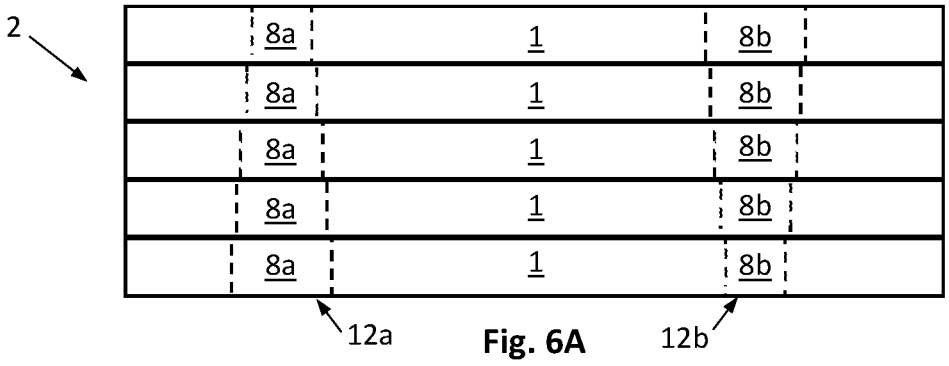
FIGS. 6A and 6B show a simplified illustration of a cross-section of a stacked plate heat exchanger in a region of the flow openings and a region of the passage openings, respectively.
Figure 6B:
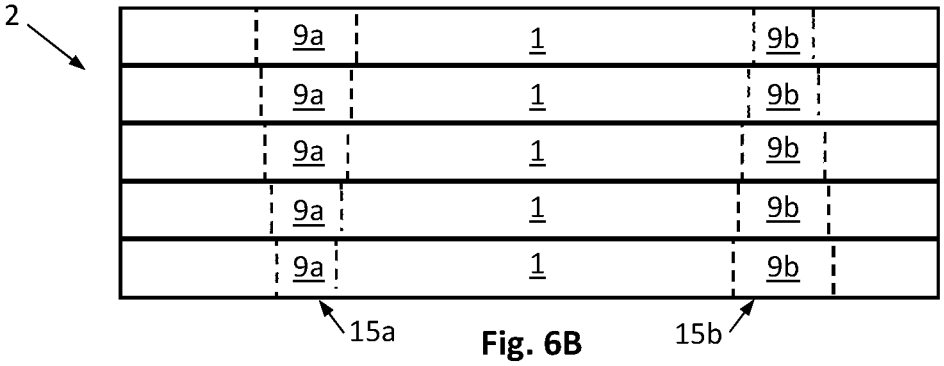
Figure 7A:
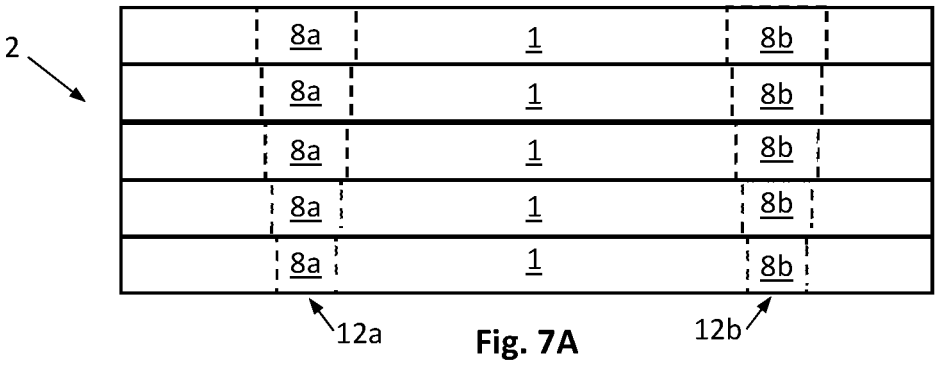
FIGS. 7A and 7B show a simplified illustration of a cross-section of a stacked plate heat exchanger in a region of the flow openings and a region of the passage openings, respectively.
Figure 7B:
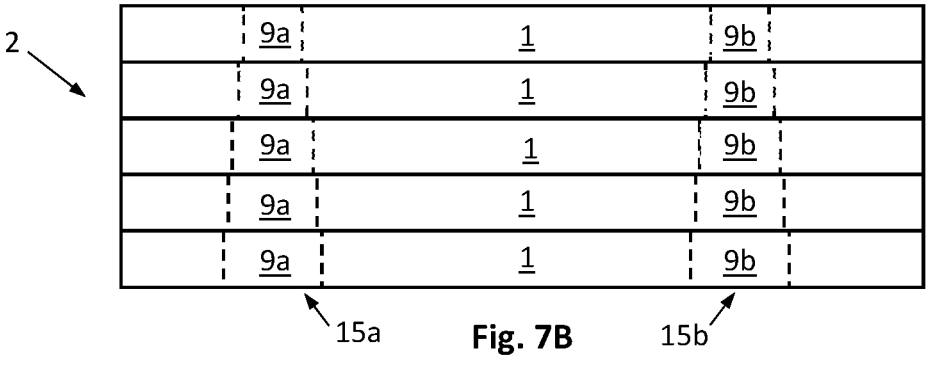

FIG. 5 shows a view of the plate 1 in the stacked plate heat exchanger 2 according to the invention. Here, the two undulating flow guide structures 13*a* and 13*b* are configured in an identical manner and are formed mirror-symmetrically at the separation shaping 11. The separation shaping 11 adjoins the first short side with the angle α close to 90°.

In summary, in the stacked plate heat exchanger 2 according to the invention, the flow cross-section in the respective plate 1 can be adapted to the aggregate state of the respective through-flowing medium $M_1$ and $M_2$. Thereby, the output- and pressure ratio in the stacked plate heat exchanger 2 can be optimized, and the volume of the respective medium $M_1$ and $M_2$ available for the heat exchange can be utilized optimally.

The invention claimed is:

1. A stacked plate heat exchanger for a motor vehicle, comprising:

a plurality of elongated plates stacked on one another, between which a plurality of cavities are disposed alternately for two media;

the plurality of cavities respectively delimited by a respective plate of the plurality of plates zonally by a plate surface of the respective plate and a surrounding wall projecting from and surrounding the plate surface;

the respective plate including two flow openings adjacently disposed at a first short side and two passage openings adjacently disposed at a second short side opposite the first short side;

the respective plate further including two domes respectively arranged around one of the two passage openings, the two domes projecting from the plate surface into a respective cavity of the plurality of cavities;

wherein at least of one of the plurality of plates further includes an elongated separation shaping arranged on the plate surface and projecting into the respective cavity, the separation shaping extending from the first short side between the two flow openings in a direction of the second short side;

wherein the separation shaping has at least two sections that extend transversely relative to one another and define an angle β therebetween; and wherein the separation shaping adjoins the first short side at an angle α of 45° to 90°.

2. The stacked plate heat exchanger according to claim 1, wherein the separation shaping is one of rectilinear and curved towards a long side of the respective plate connecting the first short side and the second short side.

3. The stacked plate heat exchanger according to claim 1, wherein:

the separation shaping has at least two rectilinear separation regions which adjoin one another and extend at the bend angle β relative to one another; and a ratio of a length of one of the two separation regions to a total length of the separation shaping is 0 to 1.

4. The stacked plate heat exchanger according to claim 1, wherein the separation shaping divides the first short side into two regions such that a ratio of a length of one of the two regions to a total length of the first short side is 0.3 to 0.5.

5. The stacked plate heat exchanger according to claim 1, wherein the separation shaping extends, from the first short side in the direction of the second short side, a length of 0.2 times to 0.8 times a length of a long side of the respective plate connecting the first short side and the second short side.

6. The stacked plate heat exchanger according to claim 1, further comprising at least one flow guide structure arranged in the respective cavity of at least one of the plurality of plates.

7. The stacked plate heat exchanger according to claim 6, wherein at least one of:

the at least one flow guide structure is a turbulence insert; and the at least one flow guide structure projects from the plate surface of the at least one of the plurality of plates into the respective cavity and includes at least one of a plurality of nub-like shapings, a plurality of elongated shapings, and a plurality of undulating shapings.

8. The stacked plate heat exchanger according to claim 6, wherein:

the at least one flow guide structure includes at least two flow guide structures;

at least one of the plurality of plates includes both the at least two flow guide structures and the separation shaping, the at least two flow guide structures arranged on opposite sides of the separation shaping; and the at least two flow guide structures are configured one of identically and differently.

9. The stacked plate heat exchanger according to claim 6, wherein the at least one flow guide structure projects from the plate surface of the at least one of the plurality of plates into the respective cavity and includes a plurality of undulating shapings that define a chevron-like pattern.

10. The stacked plate heat exchanger according to claim 1, wherein at least one of the two flow openings and the two passage openings of at least one of the plurality of plates have a respective flow cross-sectional area differing from one another.

11. The stacked plate heat exchanger according to claim 1, wherein:

the two flow openings and the two passage openings of each of the plurality of plates, which are stacked on one another, correspond with one another fluidically; and a respective flow cross-sectional area of the two flow openings and of the two passage openings of each of the plurality of plates, which are stacked on one another, one of increase and decrease continuously from plate to plate such that a flow cross-sectional area of a flow channel defined by the two flow openings of each of the plurality of plates and a flow cross-sectional area of a passage channel defined by the two passage openings of each of the plurality of plates one of increases and decreases continuously.

12. The stacked plate heat exchanger according to claim 1, wherein at least a portion of the separation shaping is rectilinear.

13. The stacked plate heat exchanger according to claim 1, wherein the separation shaping is curved towards a long side of the respective plate connecting the first short side and the second short side.

14. The stacked plate heat exchanger according to claim 1, wherein:

the surrounding wall extends along an outer perimeter of the respective plate;

the separation shaping projects from the surrounding wall at the first short side and extends between the two flow openings; and the two flow openings are disposed spaced apart from the surrounding wall at the first short side and a portion of the plate surface extends between the two flow openings and the surrounding wall at the first short side.

15. A stacked plate heat exchanger for a motor vehicle, comprising:

a plurality of elongated plates stacked on one another, between which a plurality of cavities are disposed alternately for two media;

each of the plurality of plates including:

a first short side and a second short side disposed opposite the first short side;

a plate surface;

a surrounding wall projecting from and surrounding the plate surface, the plate surface and the surrounding wall delimiting a respective cavity of the plurality of cavities;

two flow openings disposed in the plate surface adjacent to one another in a region of the first short side;

two passage openings disposed in the plate surface adjacent to one another in a region of the second short side; and two domes respectively arranged around one of the two passage openings and projecting from the plate surface into the respective cavity;

wherein at least one plate of the plurality of plates further includes an elongated separation shaping arranged on the plate surface and projecting into the respective cavity, the separation shaping extending from the first short side in a direction of the second short side between the two flow openings;

wherein the separation shaping adjoins the first short side at an angle $\alpha$ of 45° to 90°; and wherein the separation shaping includes at least two rectilinear separation portions extending transversely to one another at a bend angle $\beta$.

16. The stacked plate heat exchanger according to claim 15, wherein:

at least one of the plurality of plates includes at least one flow guide structure projecting from the plate surface into the respective cavity; and the at least one flow guide includes at least one of a plurality of nub-like shapings, a plurality of elongated shapings, and a plurality of undulating shapings.

17. The stacked plate heat exchanger according to claim 15, wherein:

the two flow openings and the two passage openings of each of the plurality of plates correspond with one another fluidically; and a respective flow cross-sectional area of the two flow openings and of the two passage openings one of increase and decrease continuously from plate to plate of the plurality of plates such that a flow cross-sectional area of a flow channel defined by the two flow openings of each of the plurality of plates and a flow cross-sectional area of a passage channel defined by the two passage openings of each of the plurality of plates one of increases and decreases continuously.

18. A stacked plate heat exchanger for a motor vehicle, comprising:

a plurality of elongated plates stacked on one another, between which a plurality of cavities are disposed alternately for two media;

the plurality of cavities respectively delimited by a respective plate of the plurality of plates zonally by a plate surface of the respective plate and a surrounding wall projecting from and surrounding an outer perimeter of the respective plate;

the respective plate including two flow openings adjacently disposed at a first short side and two passage openings adjacently disposed at a second short side opposite the first short side;

the respective plate further including two domes respectively arranged around one of the two passage openings, the two domes projecting from the plate surface into a respective cavity of the plurality of cavities;

wherein at least of one of the plurality of plates further includes an elongated separation shaping arranged on the plate surface and projecting into the respective cavity, the separation shaping projecting from the surrounding wall at the first short side and extending between the two flow openings in a direction of the second short side; and wherein the separation shaping has at least two sections that extend transversely relative to one another and define an angle $\beta$ therebetween.

* * * * *